United States Patent [19]

Masaki et al.

[11] 4,051,672

[45] Oct. 4, 1977

[54] MULTI-CYLINDER INTERNAL COMBUSTION ENGINE

[75] Inventors: Kenji Masaki; Kenji Okamura, both of Yokohama, Japan

[73] Assignee: Nissan Motor Company, Limited, Yokohama, Japan

[21] Appl. No.: 598,075

[22] Filed: July 22, 1975

[30] Foreign Application Priority Data

Sept. 20, 1974 Japan ..... 49-109185

[51] Int. Cl.[2] ..... F02B 75/10; F01N 3/10

[52] U.S. Cl. ..... 60/277; 60/282; 60/285; 123/119 R

[58] Field of Search ..... 60/285, 277, 282; 123/32 EA, 119 R, 140 MC, 139 AW, 127, 198 F

[56] References Cited

U.S. PATENT DOCUMENTS

| | | | |
|---|---|---|---|
| 3,827,237 | 8/1974 | Linder | 60/285 |
| 3,890,946 | 6/1975 | Wahl | 60/276 |
| 3,910,240 | 10/1975 | Omori | 60/285 |
| 3,910,241 | 10/1975 | Fujisawa | 60/285 |

*Primary Examiner*—Douglas Hart

[57] ABSTRACT

At relatively low afterburner temperatures cylinders of an engine are separately fed with rich and lean mixtures, while at high speeds and excessive high afterburner temperatures the cylinders are fed with only the lean mixture.

14 Claims, 4 Drawing Figures

MULTI-CYLINDER INTERNAL COMBUSTION ENGINE

The present invention relates to an improved multi-cylinder internal combustion engine which is operated on air-fuel mixtures leaner and richer than the stoichiometric air-fuel mixture to avoid noxious gas emissions.

It is well known in the art that the highest concentration of nitrogen oxides in exhaust gases from an internal combustion engine result when the engine is operated on an air-fuel mixture near the stoichiometric air-to-fuel ratio. It is also well known that an afterburner for purifying the exhaust gases from the engine functions effectively by introducing and burning therein combustibles such as carbon monoxide and hydrocarbons in the form of unburned fuel. This results from supplying the combustion chambers with an air-fuel mixture far richer than the stoichiometric mixture.

In view of these tendencies, it has already been proposed that a multi-cylinder internal combustion engine is operated by supplying an air-fuel mixture far richer than stoichiometric into a certain number of cylinders and an air-fuel mixture far leaner than stoichiometric into the remaining cylinders.

However, in the prior art, the multi-cylinder internal combustion engine will require two carburetors for feeding air-fuel mixtures far richer and leaner than stoichiometric mixtures respectively. This inevitably results in complex construction of the air induction system and fuel supply system. In addition, the air-fuel mixture far richer than stoichiometric will be unnecessarily supplied throughout all phases of engine operation even though not required. Accordingly, even during high engine speed and high engine load operations the afterburner is fed with a relatively large amount of unburned constituents in the exhaust gases from the engine and therefore is overheated and subjected to thermal damage.

It is, therefore, a main object of the present invention to provide an improved multi-cylinder internal combustion engine in which by using only one carburetor an air-fuel mixture richer than stoichiometric is supplied into certain cylinders of the multi-cylinder internal combustion engine and an air-fuel mixture leaner than stoichiometric is supplied into the remaining cylinders.

It is another object of the present invention to provide an improved multi-cylinder internal combustion engine in which only a lean air-fuel mixture is supplied to all cylinders when at least high engine speed, high engine load or damagingly high afterburner conditions exist.

Other objects and features of the improved multi-cylinder internal combustion engine according to the present invention will become more apparent from the following description taken in conjunction with the accompanying drawings in which like reference numerals and characters designate corresponding parts and elements and in which.

Figure 1:
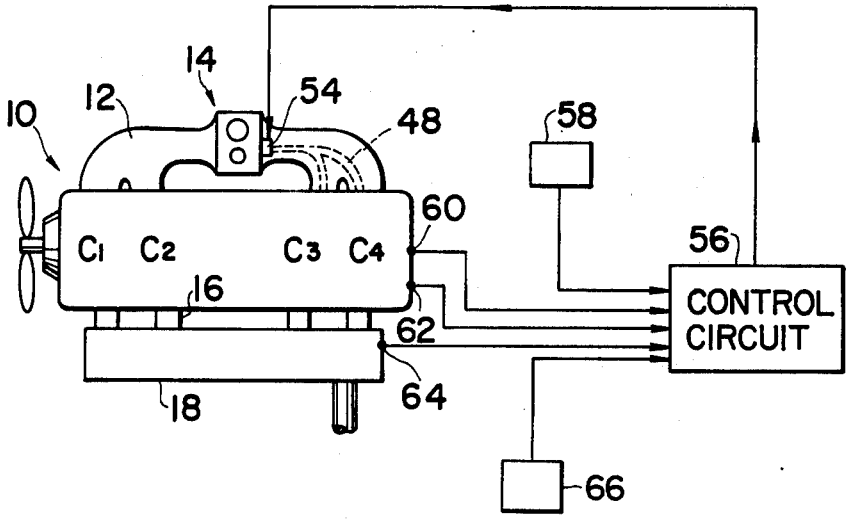
FIG. 1 is a schematic plan view showing a preferred embodiment of the present invention in which a mixture enriching device is disposed within a carburetor and an intake manifold.
Figure 2:
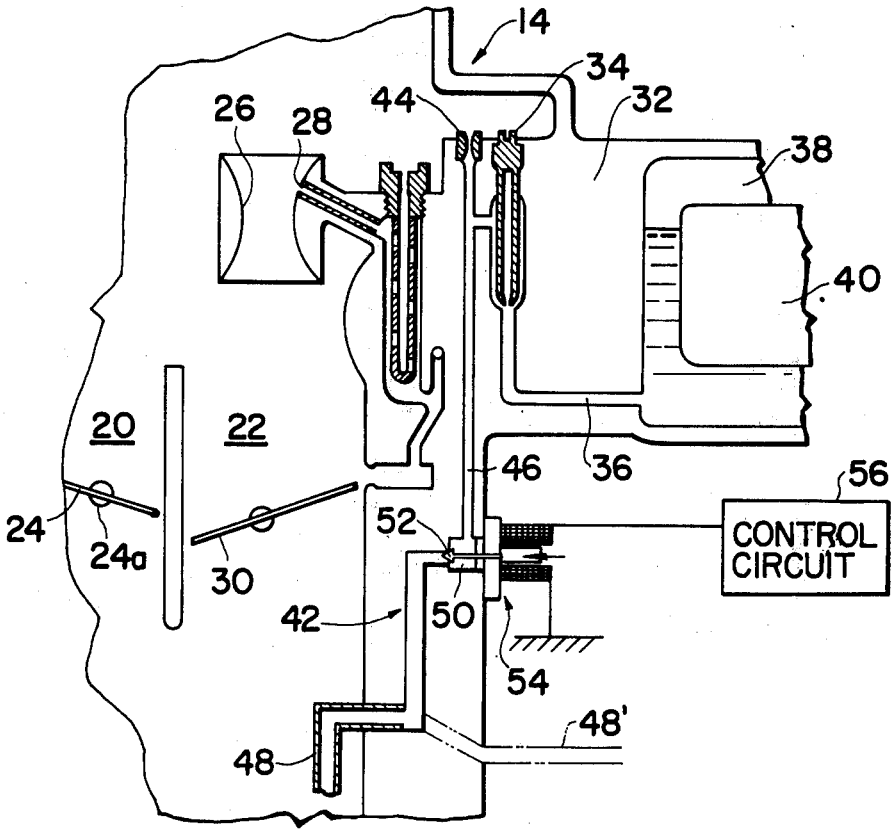
FIG. 2 is an enlarged schematic view of the carburetor shown in FIG. 1.

Referring now to the drawings, first to FIGS. 1 and 2 there is shown a preferred embodiment of the present invention in which a multi-cylinder internal combustion engine 10 is shown. The engine 10 has four cylinders $C_1$ to $C_4$ (only their locations shown). The intake ports (not shown) of the cylinders $C_1$ to $C_4$ communicate through an intake manifold 12 with a two-barrel carburetor 14 which is arranged to supply the cylinders with a first air-fuel mixture leaner than stoichiometric such as an air-fuel mixture having an air-fuel ratio ranging from 17:1 to 20:1. The exhaust ports (not shown) of the cylinders $C_1$ to $C_4$ communicate through exhaust conduits 16 with an afterburner 18 for afterburning unburned constituents in the exhaust gases discharged from all the cylinders.

An example of the two-barrel carburetor 14 is illustrated in detail in FIG. 2. As shown, the carburetor 14 comprises, as usual, the primary section 20 operative at low load engine operation and the secondary section 22 operative at medium and high load engine operations. The primary section 29 includes, as usual, a primary throttle valve 24. The secondary section 22 includes a secondary venturi 26 into which a main nozzle 28 opens, and a secondary throttle valve 30. The primary throttle valve 24 is rotatable by the accelerator pedal (not shown) through a suitable linkage. The secondary throttle valve 30 is rotatable by a primary valve shaft **24*a* through a delayed action linkage (not shown) which allows the primary throttle valve 24** to open before the secondary valve comes into operation, or by a spring-loaded diaphragm (not shown) which is actuated by the primary venturi vacuum.

Disposed in the body casting portion 32 adjacent to the secondary section 22 of the carburetor 14 is a supplemental fuel jet 34 communicating through a fuel passage 36 with a fuel chamber 38 equipped with a float 40, the fuel jet 34 forming part of a mixture enriching device 42. The fuel jet 34 is accompanied with a supplemental air bleed orifice 44 which mixes fuel from the fuel jet 34 with air. A feed passage 46 drilled through the body casting portion 32 communicates the fuel jet 34 and the orifice 44 through the lower wall portion of the body casting portion 32 with the lower air-fuel induction passage of the secondary section 22. The feed passage 46 further communicates with a feed tube 48 which extends via the inside of the air-fuel mixture induction passage of the carburetor and the intake manifold 12 into the portions upstream of the intake ports of te second group of cylinders $C_3$ and $C_4$ as indicated by a broken line in FIG. 1. The feed tube may extend via the outside of the air-fuel mixture induction passage of the carburetor and the intake manifold 12 as indicated in phantom at 48'. This mixture enriching device 42 supplies supplemental fuel into the first air-fuel mixture directed to the second group of cylinders $C_3$ and $C_4$ and therefore the first air-fuel mixture is enriched into a second air-fuel mixture richer than stoichiometric such as an air-fuel mixture having an air-fuel ratio ranging from 10:1 to 14:1. It will be understood that the air-fuel ratio of the second air-fuel mixture is adjusted by selecting the sizes of the supplemental fuel jet 34 and the air bleed orifice 44 of the mixture enriching device 42.

As shown, a chamber 50 is formed in the feed passage 46. The chamber 50 is communicated through an opening (no numeral) formed at its upper portion with the fuel jet 34 and the orifice 44, and is communicated through an opening (no numeral) formed at its side portion with the feed tube 48. Disposed at the opening formed at side portion of the chamber 50 is a valve member or valve head 52 of a normally open solenoid valve 54. The solenoid valve 54 is such arranged that the valve member 52 thereof closes the opening formed at the side portion and block the feed passage 46 when actuated.

The solenoid coil of the solenoid valve 54 is electrically connected to a control circuit 56 which is as shown in FIG. 1 in turn electrically connected to an engine load sensor 58, an engine speed sensor 60, an engine temperature sensor 62, an afterburner temperature sensor 64 and a vehicle speed sensor 66. The control circuit 56 is arranged to generate an electric signal and transmit it to the solenoid coil of the valve 54 for actuating the solenoid valve 54 when at least high engine speed, high engine load or excessively high afterburner temperature (at which afterburner is subjected to thermal damage) conditions exist. In other words, the control circuit 56 is arranged to actuate the solenoid valve 54 when at least one signal is transmitted from the sensors 58, 60, 62, 64 and 66 which signal indicates that at least one of engine speed, engine load or afterburner temperature exceeds its predetermined level. Therefore, the solenoid valve 54 can not be actuated when the engine speed, engine load, and afterburner temperature respectively do not exceed their predetermined levels, for example, during medium and low engine speed, engine load and afterburner temperature. The engine load sensor 58 may sense intake vacuum, and engine temperature sensor 62 may sense engine control temperature.

Figure 3:
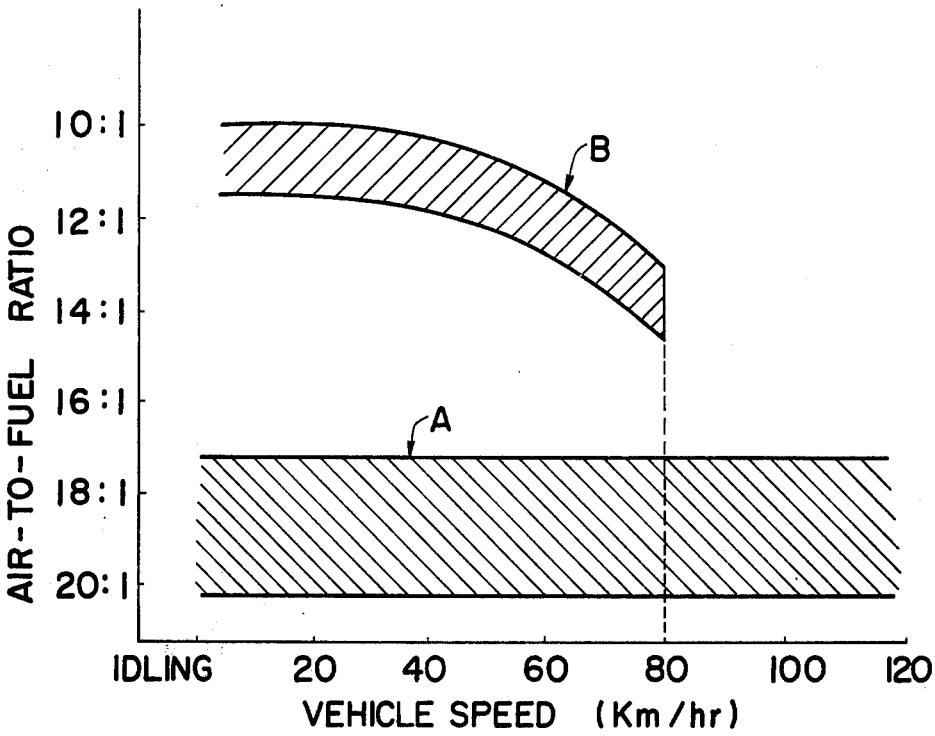
FIG. 3 is a graph showing a typical example of the relationship between air-fuel ratios and vehicle speeds, which is attained by the present invention.

While a variety of sensors 58, 60, 62, 64 and 66 have been employed in the embodiment shown in FIGS. 1 and 2 for controlling the solenoid valve 54, only one sensor such as the vehicle speed sensor may be employed for the same purpose in which it is preferable to actuate the solenoid valve 54 and stop the supplemental fuel supply from the mixture enriching device 42 when vehicle speed exceeds 80 km/hr as shown in FIG. 3. The FIG. 3 illustrates an example of the air-fuel ratio ranges of the air-fuel mixture supplied into the engine 10 at various vehicle speeds (in third gear or direct drive gear), in which a range A indicates the first air-fuel mixture leaner than stoichiometric fed into the first group of cylinders $C_1$ and $C_2$ (through all the vehicle speed) and into the second group of cylinders $C_3$ and $C_4$ (at the vehicle speed of more than 80 km/hr), and a range B indicates the second air-fuel mixture richer than stoichiometric fed into the second group of cylinders $C_3$ and $C_4$ (at the vehicle speed of up to 80 km/hr). It will be understood that the predetermined levels of the engine speed, engine load, and afterburner temperature correspond respectively to an engine speed, a road load, and an afterburner temperature at the vehicle speed of 80 km/hr., although each of these values may be attained by other engine operating conditions. For example, "high load", as recited in the claims is defined as being a load equal to or greater than, the level of road load occurring at about 80 km/hr.

While the solenoid valve 54 has been shown and described in FIG. 2 as means for controlling the supplemental fuel supply, a valve assembly actuated by a vacuum responsive diaphragm device may be employed in place of the solenoid valve 54 if the mixture enriching device 42 of the invention is controlled by only intake vacuum.

With the arrangement mentioned hereinbefore, when engine speed, engine load and afterburner temperature are lower than their predetermined levels, the first group of cylinders $C_1$ and $C_2$ are fed with the first air-fuel mixture leaner than stoichiometric while the second group of cylinders $C_3$ and $C_4$ are fed with the second air-fuel mixture richer than stoichiometric since the solenoid valve 54 is open to allow the mixture enriching device 42 to supply the supplemental fuel into the stream of the first air-fuel mixture directed to the second group of cylinders $C_3$ and $C_4$. The supplemental fuel from the mixture enriching device 42 is sucked and sprayed to the upstream portion of the intake ports by effect of the intake vacuum intermittently generated during intake stroke of the second group of cylinders $C_3$ and $C_4$. The second air-fuel mixture is gradually leaned as the engine speed or the vehicle speed increases as shown in FIG. 3 since the intake manifold vacuum decreases as the engine speed increases. However, at a relatively high engine speed such as approaching 80 km/hr, the afterburner temperature is sufficiently high to burn out harmful constituents in the exhaust gases from all the cylinders even if the second group of cylinders $C_3$ and $C_4$ are fed with the relatively lean air-fuel mixture. Thus, during relatively low engine speed, low engine load and low afterburner temperature, the first group of cylinders $C_1$ and $C_2$ are fed with the first air-fuel mixture leaner than stoichiometric while the second group of cylinders $C_3$ and $C_4$ are fed with the second air-fuel mixture richer than stoichiometric. Accordingly, nitrogen oxides NOx emission from the engine is greatly reduced and hydrocarbons HC and carbon monoxide CO from the engine are reburned in the afterburner 18 to emit harmless gases into the atmosphere. In this operating manner, the amount of HC and CO generated in the second group of cylinders $C_3$ and $C_4$ is relatively large at relatively low engine speed and low engine load and therefore reaction within the afterburner 18 is active.

When at least engine speed, engine load or afterburner temperature exceeds its predetermined level (for example, at a vehicle speed more than 80 km/hr), the solenoid valve 54 is closed in response to the electric signal transmitted from the control circuit 56 and the fuel passage 46 is blocked to stop the supplemental fuel supply into stream of the first air-fuel mixture directed to the second group of cylinders $C_3$ and $C_4$. Then, all the cylinders $C_1$ to $C_4$ are fed with the first air-fuel mixture only from the carburetor 14. It will be noted that, in this operating manner, only a small amount of unburned constituents such as HC and CO are introduced into the afterburner 18 and therefore the afterburner 18 is prevented from thermal damage resulting from excessively high reaction temperature. In addition, good fuel economy is achieved. NOx emission is also decreased since the engine does not operated on an air-fuel mixture near to or having a stoichiometric air-fuel ratio.

Figure 4:
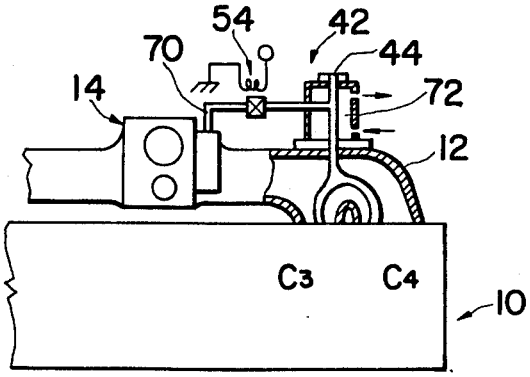
FIG. 4 is a schematic plan view showing another preferred embodiment of the present invention in which a part of the mixture enriching device is disposed outside of the carburetor and the intake manifold.

FIG. 4 illustrates another preferred embodiment according to the invention which is similar to that in FIG. 1 with the exception that fuel passage means of the mixture enriching device 42 is disposed outside of the induction passage of the carburetor 14 and the intake manifold 12. As shown, a feed conduit 70 connects the fuel chamber (not shown) of the carburetor 14 and the portions upstream of the second group of cylinders $C_3$ and $C_4$ through the supplemental fuel jet (not shown), the solenoid valve 54 and the supplemental air bleed orifice 44. A part of the feed conduit 70 is surrounded by a heating chamber 72 or heating means. Through the heating chamber 72, hot fluid such as heated engine coolant or exhaust gases is allowed to pass to heat the part of the feed conduit 70. With this arrangement, vaporization of the supplemental fuel passing through the feed conduit 70 is promoted and accordingly improved combustion is carried out within the second group of cylinders $C_3$ and $C_4$.

It will be understood that while only the two-barrel carburetor 14 has been shown and described in the embodiments in FIGS. 1, 2 and 4, a single-barrel and other types of carburetors may be used for the same purpose.

What is claimed is:

1. A multi-cylinder internal combustion engine having a first group of cylinders and a second group of cylinders, the engine being followed by an after-burner to purifying exhaust gases discharged from the first and second groups of cylinders, said engine comprising:

a carburetor for supplying into the first and second groups of cylinders a first air-fuel mixture whoch is leaner than the stoichiometric air fuel mixture;

a mixture enriching device arranged to supply supplemental fuel from the fuel chamber of said carburetor into portions upstream of the intake ports of said second group of cylinders to enrich the first air-fuel mixture into a second air-fuel mixture which is richer than the stoichiometric air-fuel mixture; and control means to cause said mixture enriching device to stop supply of the supplemental fuel during at least one of high engine speed, high engine load, and excessively high afterburner temperature.

2. A multi-cylinder internal combustion engine as claimed in claim 1, in which said mixture enriching device includes:

a supplemental fuel jet communicating with the fuel chamber of said carburetor;

fuel passage means communicating said supplemental fuel jet with the portions upstream of the intake ports of said second group of cylinders to admit fuel from the fuel chamber of said carburetor into the portions upstream of the intake ports of said second group of cylinders;

a supplemental air bleed orifice communicating with said fuel passage means.

3. A multi-cylinder internal combustion engine as claimed in claim 2, in which said control means includes:

a normally open solenoid valve arranged to close and block said fuel passage means in response to an electric signal transmitted thereto;

at least one sensor which senses engine speed, engine load or afterburner temperature, respectively;

a control circuit electrically connected between said normally open solenoid valve and said at least one sensor, said control circuit being arranged to generate the electric signal and transmit it to said normally open solenoid valve when at least one of engine speed, engine load and afterburner temperature exceeds a predetermined level.

4. A multi-cylinder internal combustion engine as claimed in claim 3, in which said at least one sensor includes an engine speed sensor, a vehicle speed sensor, an engine load sensor, an engine temperature sensor or an afterburner temperature sensor.

5. A multi-cylinder internal combustion engine as claimed in claim 4, in which said engine temperature sensor senses engine coolant temperature.

6. An internal combustion engine as claimed in claim 4, in which said engine load sensor senses intake vacuum.

7. A multi-cylinder internal combustion engine as claimed in claim 2, in which said fuel passage means includes a first portion which is a feed passage formed within the body casting portion of said carburetor, and a second portion which is a feed tube connecting said feed passage to the portions upstream of the intake ports of said second group of cylinders.

8. A multi-cylinder internal combustion engine as claimed in claim 2, in which said fuel passage means includes a feed conduit connecting said supplemental fuel jet and the portions upstream of the intake ports of said second group of cylinders through the outside of the air-fuel mixture induction passage of the carburetor and the outside of intake manifold

9. A multi-cylinder internal combustion engine as claimed in claim 8, in which a portion of said feed conduit is surrounded with heating means for promoting vaporization of the fuel flowing through said feed conduit.

10. A multi-cylinder internal combustion engine as claimed in claim 9, in which said heating means is a chamber through which hot fluid flows.

11. A multi-cylinder internal combustion engine as claimed in claim 9, in which said heating means is a chamber through which exhaust gases flow.

12. A multi-cylinder internal combustion engine as claimed in claim 1, in which said first air-fuel mixture has an air-fuel ratio ranging from 17:1 to 20:1.

13. A multi-cylinder internal combustion engine as claimed in claim 12, in which said second air-fuel mixture has an air-fuel ratio ranging from 10:1 to 14:1.

14. A multi-cylinder internal combustion engine having a first group of cylinders and a second group of cylinders, the engine being followed by an afterburner to purify exhaust gases discharged from the first and second groups of cylinders, said engine comprising:

a carburetor for supplying into the first and second groups of cylinders a first air-fuel mixture having an air-fuel ratio ranging from 17:1 to 20:1, said carburetor including a supplemental fuel jet communicating with the fuel chamber of the carburetor, a feed passage communicating the fuel jet with the air-fuel mixture induction passage of said carburetor, a supplemental air bleed orifice communicating with the feed passage, and a chamber disposed in the feed passage and having a first opening which communicates with the supplemental fuel jet, and a second opening which communicates with the air-fuel mixture induction passage of said carburetor;

a feed tube communicating the feed passage of said carburetor downstream of said chamber with portions upstream of the intake ports of the second group of cylinders, the supplemental fuel jet and the supplemental air bleed orifice being selected to supply supplemental fuel from the fuel chamber of said carburetor through the feed passage and said feed tube in a manner to enrich the first air-fuel mixture into a second air-fuel mixture having an air-fuel ratio ranging from 10:1 to 14:1;

a normally open solenoid valve disposed with said carburetor, the valve member of said solenoid valve being arranged to close the second opening of the feed chamber of said carburetor in response to an electric signal transmitted thereto;

at least one sensor which senses at least one parameter of engine speed, engine load and afterburner temperature;

a control circuit electrically connected between said normally open solenoid valve and said at least one sensor, said control circuit being arranged to generate an electric signal and transmit it to said normally open solenoid valve when the at least one parameter of engine speed, engine load and afterburner temperature exceeds its predetermined level.

* * * * *